US008991802B1

(12) United States Patent
Southworth

(10) Patent No.: US 8,991,802 B1
(45) Date of Patent: Mar. 31, 2015

(54) TOOL FOR ALIGNING HIGHWAY BARRIER MODULES

(71) Applicant: George L. Southworth, Tampa, FL (US)

(72) Inventor: George L. Southworth, Tampa, FL (US)

( * ) Notice: Subject to any disclaimer, the term of this patent is extended or adjusted under 35 U.S.C. 154(b) by 252 days.

(21) Appl. No.: 13/852,122

(22) Filed: Mar. 28, 2013

(51) Int. Cl.
*B25B 1/24* (2006.01)
*B66F 19/00* (2006.01)
*B25B 1/00* (2006.01)

(52) U.S. Cl.
CPC . *B66F 19/00* (2013.01); *B25B 1/00* (2013.01); *B25B 1/24* (2013.01)
USPC ..... 269/43

(58) Field of Classification Search
CPC .... B25B 1/2478; B25B 1/103; B25B 1/2405; B66F 19/00
USPC ..... 29/143, 238–239, 244–282; 254/100, 254/103, 134; 269/3, 6, 43, 95, 228, 249
See application file for complete search history.

(56) References Cited

U.S. PATENT DOCUMENTS

| | | | | | |
|---|---|---|---|---|---|
| 1,459,093 | A * | 6/1923 | French | 269/156 |
| 2,232,112 | A * | 2/1941 | Hubbell et al. | 254/100 |
| 2,610,661 | A * | 9/1952 | Romine | 269/156 |
| 2,636,527 | A * | 4/1953 | Schiemann | 269/45 |
| 2,659,561 | A * | 11/1953 | Kindorf | 248/228.6 |
| 2,778,393 | A * | 1/1957 | Golasowski | 269/63 |
| 2,867,003 | A * | 1/1959 | Stiles | 249/82 |
| 4,234,176 | A * | 11/1980 | Goff et al. | 269/156 |
| 4,369,957 | A * | 1/1983 | Williams | 269/41 |
| 4,627,604 | A * | 12/1986 | Choi | 269/214 |
| 4,662,055 | A * | 5/1987 | VanMeter | 29/467 |
| 4,828,241 | A * | 5/1989 | Yang | 269/114 |
| 5,074,536 | A * | 12/1991 | McConkey | 269/43 |
| 5,123,773 | A * | 6/1992 | Yodock | 404/6 |
| 5,622,354 | A * | 4/1997 | Chagnot | 254/100 |
| 6,000,686 | A * | 12/1999 | Yates | 269/6 |
| 6,338,477 | B1 * | 1/2002 | Moore | 269/60 |
| 6,431,534 | B1 * | 8/2002 | Orosz et al. | 269/43 |
| 8,226,074 | B1 * | 7/2012 | Hughey | 269/155 |
| 8,567,292 | B1 * | 10/2013 | Park et al. | 81/462 |
| 2004/0182977 | A1 * | 9/2004 | Weiss | 248/231.71 |
| 2012/0025437 | A1 * | 2/2012 | Allred et al. | 269/249 |
| 2012/0119427 | A1 * | 5/2012 | Weissenborn | 269/95 |

* cited by examiner

*Primary Examiner* — Lee D Wilson
*Assistant Examiner* — Marc Carlson
(74) *Attorney, Agent, or Firm* — Ronald E. Smith; Smith & Hopen, P.A.

(57) ABSTRACT

An apparatus for aligning barrier wall modules atop a retaining wall includes a flat base transversely disposed relative to a longitudinal axis of the retaining wall. The flat base is positioned between adjacent barrier wall modules disposed in end-to-end relation to one another atop the retaining wall. The flat base includes a central part, first and second flat arms and first and second elongate bolts secured to and extending from respective free ends of the first and second flat arms in opposite directions. First and second nuts screw-threadedly engage the first and second bolts. First and second housings slidingly ensleeve the first and second arms and the first and second bolts respectively. The first and second housings abut first and second sides of adjacent barrier modules when the first and second nuts are advanced and control positioning of the barrier modules atop the retaining wall.

8 Claims, 5 Drawing Sheets

TOOL FOR ALIGNING HIGHWAY BARRIER MODULES

BACKGROUND OF THE INVENTION

1. Field of the Invention

This invention relates, generally, to highway barrier module installation. More particularly, it relates to a tool that facilitates alignment of barrier modules atop a retaining wall.

2. Description of the Prior Art

A highway barrier wall is formed of a plurality of barrier modules that are placed end-to-end alongside an elevated highway or overpass to prevent vehicles that leave the road from falling. The modules are placed atop a retaining wall that retains the earth atop which the highway is built.

A piece of heavy construction equipment such as a front loader, an excavator or the like unloads the barrier modules one at a time atop the retaining wall. The heavy equipment operator works with a work crew until each module is properly aligned, i.e., the operator applies a lifting force to each module so that the workers can manually shove or pry it into a desired position and then removes the lifting force. If the alignment is unacceptable, the procedure is repeated until the heavy module is in an acceptable position.

The primary drawback of this well-known installation technique is that the heavy equipment operator and of course the heavy equipment must remain at the site of each barrier wall module until each module is properly aligned with its adjacent modules. The heavy equipment and its operator are billed hourly so substantial monies could be saved if the alignment process required less time.

The prior art teaches that elongate boards can be used during the barrier module alignment process. An elongate board is placed on each side of a barrier module junction and a through bolt is used to pull the opposed boards toward one another, thereby causing two (2) adjacent barrier modules to enter into flush alignment with one another.

The problem with this well-known procedure is that it can only align adjacent barrier modules with one another but it cannot adjust the position of the barrier modules with respect to the underlying retaining wall. Since a retaining wall is unlikely to be perfectly straight, the barrier modules will meander, flush with one another at each barrier module junction but collectively following a non-straight path of travel defined by the retaining wall.

There are no prior art tools that enable alignment of barrier modules relative to a meandering retaining wall so that adjacent barrier modules are not only flush with one another, but are also longitudinally aligned with one another so that the barrier modules collectively form a straight line even when mounted atop a non-straight retaining wall.

In view of the art considered as a whole at the time the present invention was made, it was not obvious to those of ordinary skill in the art how the known barrier alignment methods could be improved.

SUMMARY OF THE INVENTION

The long-standing but heretofore unfulfilled need for a device that facilitates flush alignment of adjacent highway barrier modules atop retaining walls and which enables barrier modules to collectively form a straight barrier even when mounted atop a non-straight retaining wall is now met by a new, useful, and non-obvious invention.

The novel structure is a tool for aligning barrier wall modules atop a retaining wall so that each member of an adjacent pair of modules is flush with one another and so that a large plurality of modules can be collectively placed into a straight line atop a non-straight retaining wall.

The novel tool includes a flat base adapted to be transversely disposed relative to a longitudinal axis of a retaining wall. The flat base is also adapted to be positioned between adjacent barrier wall modules disposed in end-to-end relation to one another atop the retaining wall.

The flat base includes a central part, a flat first arm and a flat second arm. The first and second flat arms are integrally formed with and extend from the central part in opposite directions relative to one another and in co-planar alignment with the flat central part.

A retaining wall-receiving notch is cut out from the central part of the novel tool. The notch has a depth sufficient to receive a predetermined vertical extent of a retaining wall therein and has a width sufficient to receive a predetermined width of the retaining wall. Since retaining walls are provided in various widths, the notch has a width greater than the width of most retaining walls. Barrier modules also have a retaining wall-receiving notch formed in their bottom walls as well, and said notches are also wider than the widest retaining walls for the same reason and to provide a tolerance for field alignment.

The flat base further includes a first elongate bolt and a second elongate bolt. The first and second elongate bolts are secured to and extend from respective free ends of the first and second flat arms in opposite directions relative to one another and in longitudinal alignment with the first and second flat arms.

A first nut is in screw-threaded engagement with the first elongate bolt and a second nut is in screw-threaded engagement with the second elongate bolt.

A first housing ensleeves the first flat arm and the first elongate bolt and is slideably mounted with respect to the first flat arm and the first elongate bolt. The first housing moves toward the central part, i.e., in an outboard-to-inboard direction, when the first nut is advanced toward the central part.

A second housing ensleeves the second flat arm and the second elongate bolt and is slideably mounted with respect to said second flat arm and the second elongate bolt. The second housing moves toward said central part, i.e., in an outboard-to-inboard direction, when the second nut is advanced towards the central part.

The first housing has a parallelepiped structure that includes sidewalls disposed parallel to the first flat arm and the first elongate bolt, an inboard wall disposed transverse to the sidewalls and an outboard wall disposed transverse to the sidewalls.

The second housing has a parallelepiped structure that includes sidewalls disposed parallel to the second flat arm and the second elongate bolt, an inboard wall disposed transverse to the second housing sidewalls and an outboard wall disposed transverse to the second housing sidewalls.

The inboard wall of the first housing has a central aperture formed therein to slidingly receive the first elongate bolt. The inboard wall of the first housing also has a pair of rectangular slots in open communication with the central aperture that extend radially from the central aperture in opposite directions. The pair of rectangular slots slidingly receive the first flat arm.

The outboard wall of the first housing has a central aperture formed therein to slidingly receive the first elongate bolt.

The inboard wall of the second housing has a central aperture formed therein to slidingly receive the second elongate bolt. The inboard wall of the second housing has a pair of rectangular slots in open communication with the central aperture of the second housing that extend radially from the second housing central aperture in opposite directions. The pair of rectangular slots slidingly receive the second flat arm.

The outboard wall of the second housing has a central aperture formed therein to slidingly receive the second elongate bolt.

The respective inboard walls of the first and second housings are each preferably provided with a flange so that pressure applied to adjacent barrier modules by said first and second housings is spread over a large surface area.

The first housing is adapted to abut the first sides of two confronting barrier modules at their junction when the first nut is advanced and the second housing is adapted to abut second, opposite sides of those barrier modules when the second nut is advanced. Relative advancement of the first and second nuts therefore brings the two barrier modules into flush relation to one another at their junction or parting line. This particular function can also be performed by boards and a through bolt but the novel tool is easier to work with.

After the barrier modules have been positioned atop the retaining wall in flush relation to one another, the novel tool also enables longitudinal alignment of the barrier modules with one another even if the supporting retaining wall is not perfectly straight, i.e., if the retaining wall meanders relative to a straight path of travel. This important function cannot be performed by the prior art assembly of boards and a through bolt.

An important object of this invention is to facilitate the installation of elongate highway barrier modules by providing a tool that aligns adjacent barrier modules into flush relation with one another in the absence of an excavator, front loader, or other item of heavy equipment.

An even more important object is to enable straight alignment of barrier modules atop a retaining wall that is not straight.

A closely related object is to reduce the time and expense required to install elongate highway barrier modules by providing a tool that can be handled by two workers, one on each side of a retaining wall, with no further assistance provided by a piece of heavy equipment and its operator after the barrier modules have been positioned atop the retaining wall.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
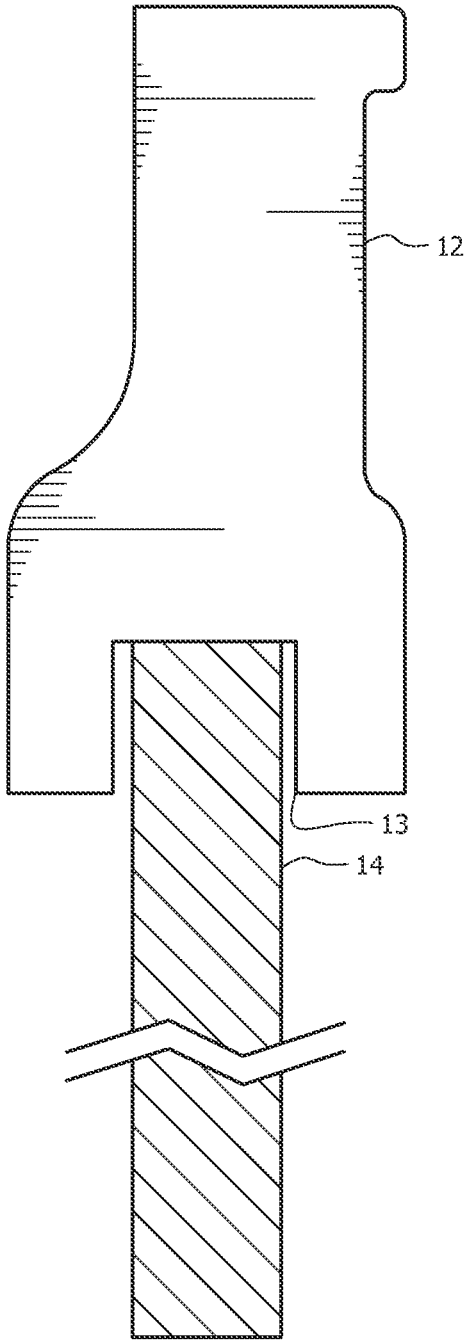
FIG. 1 is an end view of a highway barrier module seated atop a retaining wall.

FIG. 1 depicts a barrier module 12 positioned atop a retaining wall 14. The top of retaining wall 14 is received within notch 13.

Figure 2:
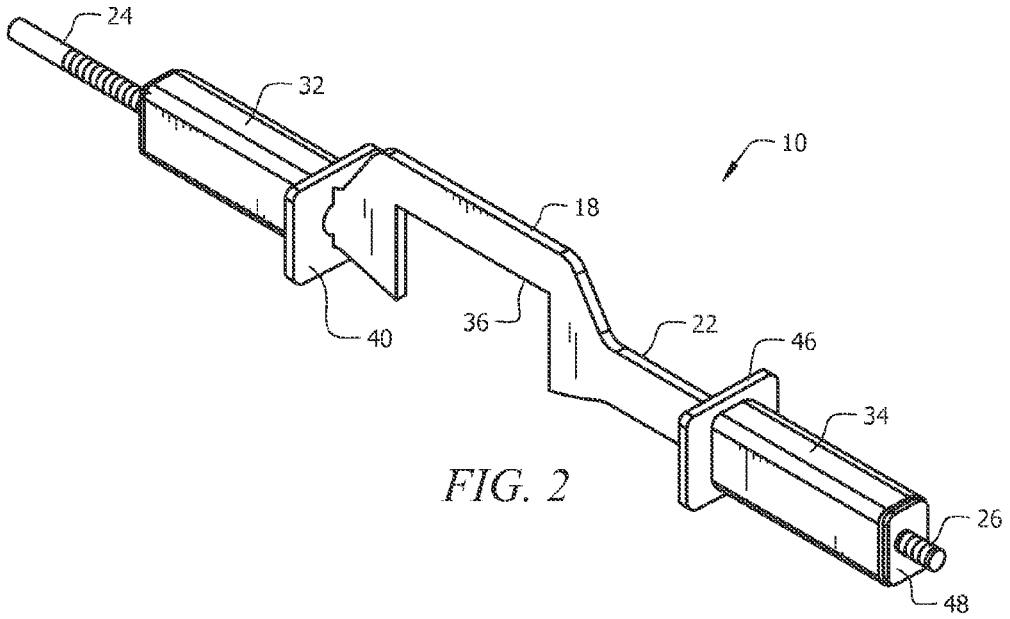
FIG. 2 is a perspective view of the novel barrier module alignment tool.
Figure 3A:
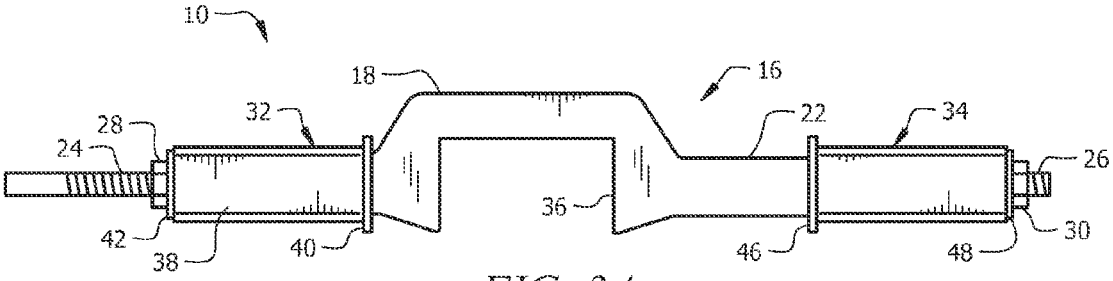
FIG. 3A is a side elevational view of the tool depicted in FIG. 2.
Figure 3B:
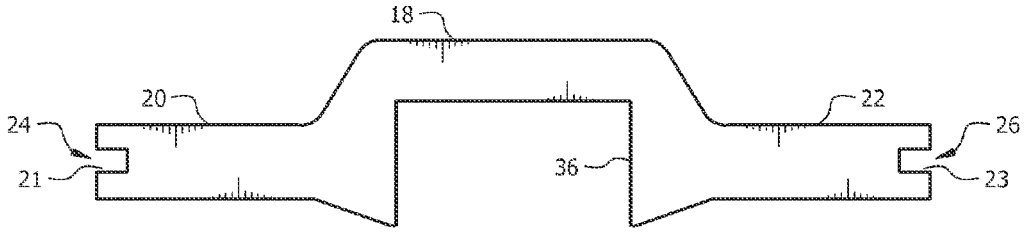
FIG. 3B is a side elevational view of the flat base of the tool.
Figure 4:
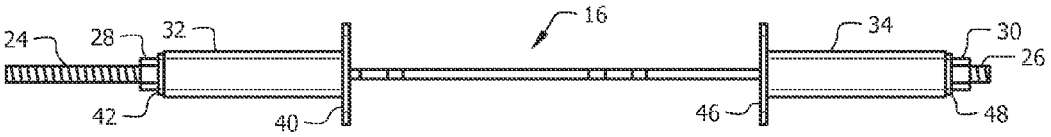
FIG. 4 is a top plan view of the tool depicted in FIGS. 2 and 3A.
Figure 5:
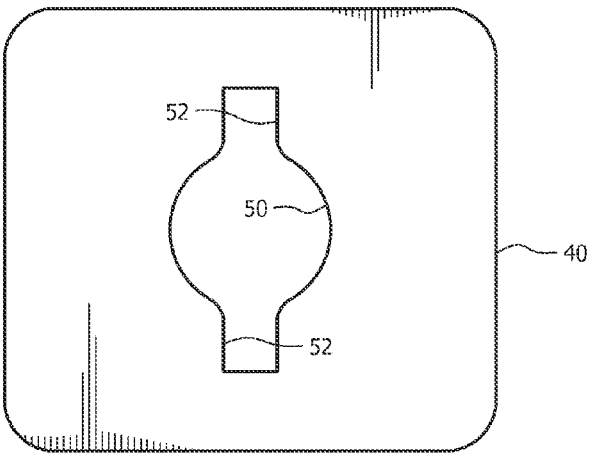
FIG. 5 is an end elevational view of the inboard wall of a housing.
Figure 6:
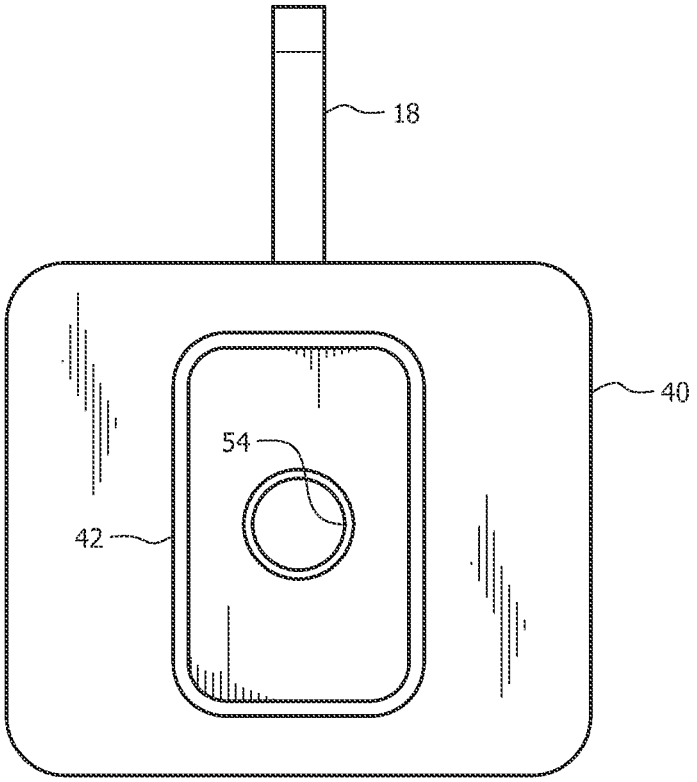
FIG. 6 is an end elevational view of the outboard wall of a housing.
Figure 7:
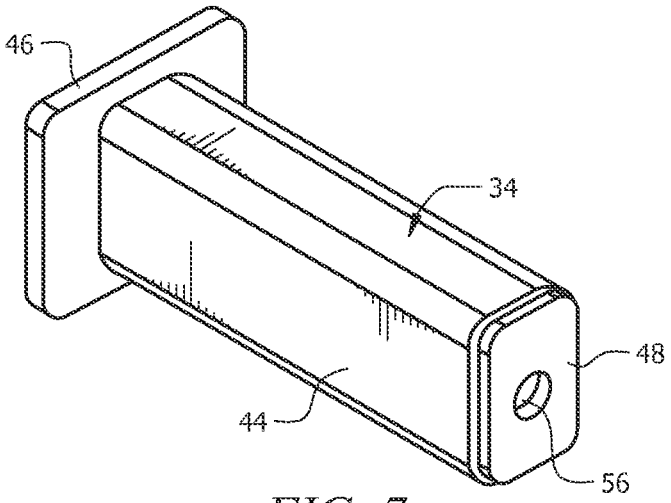
FIG. 7 is a perspective view of the second housing.

FIG. 2 depicts an illustrative embodiment of the inventive structure which is denoted as a whole by the reference numeral 10.

Flat base 16 is adapted to be transversely disposed relative to a longitudinal axis of retaining wall 14. Flat base 16 is adapted to be positioned between adjacent barrier wall modules 12 disposed in end-to-end relation to one another atop retaining wall 14.

Flat base 16 includes flat central part 18, flat first arm 20 and flat second arm 22. First and second flat arms 20, 22 are integrally formed with and extend from flat central part 18 in opposite directions relative to one another and in co-planar alignment with said flat central part.

Flat base 16 further includes first elongate bolt 24 and second elongate bolt 26. First and second elongate bolts 24 and 26 are secured to and extend from respective free ends of first and second flat arms 20, 22 in opposite directions relative to one another and in longitudinal alignment with the first and second flat arms. Notches 21 and 23 provide connection points for the respective inboard ends of bolts 24 and 26, said connection preferably being made by welding.

First nut 28 is in screw-threaded engagement with first elongate bolt 24 and second nut 30 is in screw-threaded engagement with second elongate bolt 26.

First housing 32 ensleeves first flat arm 20 and first elongate bolt 24 and is slideably mounted with respect to said first flat arm and said first elongate bolt. First housing 32 is movable toward central part 18 when first nut 28 is advanced toward said central part, i.e., in an outboard-to-inboard direction.

Second housing 34 ensleeves second flat arm 22 and second elongate bolt 26 and is slideably mounted with respect to said second flat arm and said second elongate bolt. Second housing 34 is movable toward central part 18 when second nut 30 is advanced toward central part 18, i.e., in an outboard-to-inboard direction.

Retaining wall-receiving notch 36 is cut out from central part 18. Notch 36 has a depth sufficient to receive a predetermined vertical extent of retaining wall 14 therein and has a width sufficient to receive a predetermined width of said retaining wall. Central part 18 may be provided with a vertical extent that exceeds the vertical extent of the first and second arms in order to maintain a robust central part even when a large notch is cut therefrom.

In a preferred embodiment, first housing 32 has a parallelepiped structure that includes sidewalls 38 disposed parallel to first flat arm 20 and first elongate bolt 24. Inboard wall 40 is disposed transversely to sidewalls 38 and is preferably provided with flanges as depicted so that inboard wall 40 has a height and width extent that exceeds the height and width extent of housing 34. Outboard wall 42 is also disposed transversely to sidewalls 38.

Inboard wall 40 of first housing 32 has a central aperture 50 formed therein to slidingly receive first elongate bolt 24.

Inboard wall 40 also has a pair of rectangular slots, collectively denoted 52, formed therein in open communication with central aperture 50 and extending radially from said central aperture in opposite directions, said pair of rectangular slots 52 slidingly receiving first flat arm 20.

Outboard wall 42 of first housing 32 has central aperture 54 formed therein to slidingly receive first elongate bolt 24.

In the preferred embodiment, second housing 34 has a parallelepiped structure that includes sidewalls 44 disposed parallel to second flat arm 22 and second elongate bolt 26. Inboard wall 46 is disposed transversely to second housing sidewalls 44 and outboard wall 48 is disposed transversely to said second housing sidewalls.

Inboard wall 46 of second housing 34 has the same structure as inboard wall 40 of first housing 32, i.e., it includes a central aperture formed therein to slidingly receive second elongate bolt 26 and it further includes a pair of rectangular slots formed therein in open communication with the central aperture, said rectangular slots extending radially from the central aperture in opposite directions and slidingly receiving second flat arm 22.

Outboard wall 48 of second housing 34 has central aperture 56 formed therein to slidingly receive second elongate bolt 26.

In the preferred embodiment, the respective inboard walls 40 and 46 of first and second housings 32 and 34 include flanges as depicted so that pressure applied to adjacent barrier modules 12 by said first and second housings is spread over a large surface area. Inboard walls 40 and 46 could be flangeless, i.e., they could have substantially the same dimensions of outboard walls 42 and 48.

The inboard end of first housing 32 abuts a first, highway side of two (2) adjacent barrier modules 12 when first nut 28 is advanced and the inboard end of second housing 34 abuts a second, opposite side of the adjacent barrier modules 12 when second nut 30 is advanced. Accordingly, relative advancement of the first and second nuts in an outboard-to-inboard direction brings adjacent barrier modules 12 into flush relation to one another atop retaining wall 14.

Novel alignment tool 10 enables a heavy equipment operator to deposit a large number of barrier modules 12 along the extent of a retaining wall 14 and to leave the area to perform other work, there being no need for the heavy equipment operator to provide further assistance in the alignment process for each barrier module. Two workers, one on each side of a pair of adjacent barrier modules, can perform the needed alignment in the absence of further heavy equipment assistance once the operator has deposited the barrier modules atop the retaining wall in closely spaced, end-to-end relation to one another. The only other tool required is a wrench for each worker to facilitate turning of nuts 28 and 30.

It is possible to simplify novel tool 10 by eliminating one of the two flat arms 20, 22. The alignment work can be accomplished by using only one (1) of said two (2) flat arms, i.e., tool 10 could have one (1) arm and be used from one side of the barrier wall and then from the other side to do the same job.

In the one arm apparatus, the flat base includes a flat end part and a flat arm. A retaining wall-receiving notch is cut out from the end part. The notch has a depth sufficient to receive a predetermined vertical extent of a retaining wall therein and has a width sufficient to receive a predetermined width of the retaining wall.

The flat arm is integrally formed with and extends from the end part in co-planar alignment with the end part. The flat base includes an elongate bolt which is secured to and extends from the flat arm in longitudinal alignment with the flat arm. A nut is in screw-threaded engagement with the elongate bolt. A housing ensleeves the flat arm and the elongate bolt and is slideably mounted with respect to the flat arm and the elongate bolt. The housing is movable toward the end part when the nut is advanced toward the end part. The housing is adapted to abut a first side of a pair of confronting barrier modules when the nut is advanced. Advancement of the nut brings the adjacent barrier modules into flush relation to one another.

The housing has a parallelepiped structure that includes sidewalls disposed parallel to the flat arm and the elongate bolt. An inboard wall is disposed transverse to the sidewalls as is an outboard wall.

The inboard wall of the housing has a central aperture formed therein to slidingly receive the elongate bolt. The inboard wall of the housing also has a pair of rectangular slots in open communication with the central aperture. The slots extend radially from the central aperture in opposite directions. The pair of rectangular slots slidingly receive the flat arm.

The outboard wall of the housing has a central aperture formed therein to slidingly receive the elongate bolt. The inboard wall of the housing includes a flange so that pressure applied to adjacent barrier modules by the housing is spread over a large surface area.

The novel device performs two (2) functions, one of which can be performed by prior art devices and one of which cannot.

In the first function, the novel structure brings two barrier modules into flush relation with each other at their juncture. Prior art devices that employ boards and a through bolt interconnecting the boards can also perform that function. The novel structure does not require boards and a through bolt and can thus perform the alignment function in a better way, but the alignment function alone can be performed by said prior art boards and through bolts.

In the second function, which cannot be performed by prior art devices, the novel apparatus can shift a plurality of adjacent, flush barrier modules into a straight alignment with one another even when mounted atop a non-straight barrier wall.

Both functions are performed after an excavator, front end loader, or other piece of heavy equipment has deposited the barrier modules atop a retaining wall and left the area.

More particularly, after positioning the notch of the novel tool over the top of the retaining wall and performing the flush alignment procedure, the second function is performed by pulling adjacent barrier modules inward by loosening the inside nut and tightening the outside nut, or by pushing adjacent barrier modules outwardly by loosening the outside nut and tightening the inside nut. This brings the barrier modules into longitudinal alignment with one another even if they are mounted atop a non-straight retaining wall.

Figure 8A:
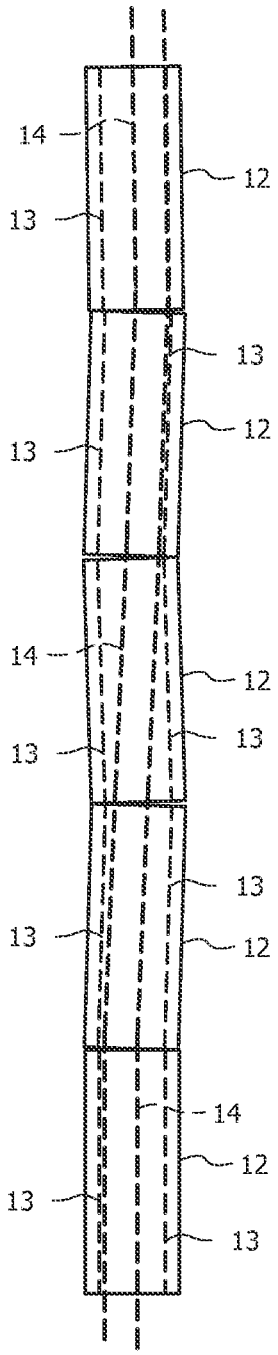
FIG. 8A depicts meandering barrier modules atop a meandering retaining wall.

FIG. 8A depicts barrier modules 12 immediately after they are placed on the top of retaining wall 14. They are offset and out of alignment with one another.

Figure 8B:
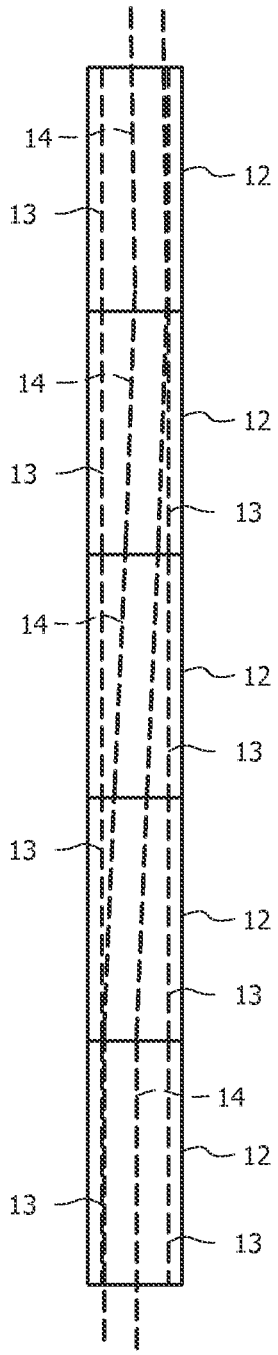
FIG. 8B depicts barrier modules in straight alignment with one another atop a meandering retaining wall as attained by the novel tool.

FIG. 8B depicts barrier modules 12 after novel device 10 has performed its two (2) functions: 1) The barrier modules are clamped so that their abutting ends are not offset from each other; and 2) The barrier modules are aligned in a straight line on top of meandering retaining wall 14. The second function cannot be performed by prior art devices.

The notch formed in the bottom wall of barrier modules 12 is indicated by parallel dotted lines 13.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for aligning barrier wall modules atop a retaining wall, comprising:

a flat base adapted to be transversely disposed relative to a longitudinal axis of said retaining wall, said flat base adapted to be positioned between adjacent barrier wall modules disposed in end-to-end relation to one another atop said retaining wall;

said flat base including a central part, a flat first arm and a flat second arm, said first and second flat arms being integrally formed with and extending from said central part in opposite directions relative to one another and in co-planar alignment with said central part;

a retaining wall-receiving notch cut out from said central part, said notch having a depth sufficient to receive a predetermined vertical extent of said retaining wall therein and having a width sufficient to receive a predetermined width of said retaining wall;

said flat base further including a first elongate bolt and a second elongate bolt, said first and second elongate bolts being secured to and extending from respective free ends of said first and second flat arms in opposite directions relative to one another and in longitudinal alignment with said first and second flat arms;

a first nut in screw-threaded engagement with said first elongate bolt and a second nut in screw-threaded engagement with said second elongate bolt;

a first housing that ensleeves said first flat arm and said first elongate bolt and which is slideably mounted with respect to said first flat arm and said first elongate bolt;

said first housing being movable toward said central part when said first nut is advanced toward said central part;

a second housing that ensleeves said second flat arm and said second elongate bolt and which is slideably mounted with respect to said second flat arm and said second elongate bolt;

said second housing being movable toward said central part when said second nut is advanced toward said central part;

said first housing adapted to abut a first, highway side of a pair of adjacent barrier modules when said first nut is advanced;

said second housing adapted to abut a second, opposite side of said pair of adjacent barrier modules when said second nut is advanced;

whereby relative advancement of said first and second nuts brings said pair of adjacent barrier modules into flush relation to one another atop said retaining wall.

2. The apparatus of claim 1, further comprising:

said first housing having a parallelepiped structure that includes sidewalls disposed parallel to said first flat arm and said first elongate bolt, an inboard wall disposed transverse to said sidewalls and an outboard wall disposed transverse to said sidewalls;

said second housing having a parallelepiped structure that includes sidewalls disposed parallel to said second flat arm and said second elongate bolt, an inboard wall disposed transverse to said second housing sidewalls and an outboard wall disposed transverse to said second housing sidewalls.

3. The apparatus of claim 2, further comprising:

said inboard wall of said first housing having a central aperture formed therein to slidingly receive said first elongate bolt;

said inboard wall of said first housing having a pair of rectangular slots in open communication with said central aperture and extending radially from said central aperture in opposite directions, said pair of rectangular slots slidingly receiving said first flat arm;

said outboard wall of said first housing having a central aperture formed therein to slidingly receive said first elongate bolt;

said inboard wall of said second housing having a central aperture formed therein to slidingly receive said second elongate bolt;

said inboard wall of said second housing having a pair of rectangular slots in open communication with said central aperture and extending radially from said central aperture in opposite directions, said pair of rectangular slots slidingly receiving said second flat arm;

said outboard wall of said second housing having a central aperture formed therein to slidingly receive said second elongate bolt.

4. The apparatus of claim 3, further comprising:

respective inboard walls of said first and second housings including a flange so that pressure applied to adjacent barrier modules by said first and second housings is spread over a large surface area.

5. An apparatus for aligning barrier wall modules atop a retaining wall, comprising:

a flat base adapted to be transversely disposed relative to a longitudinal axis of said retaining wall, said flat base adapted to be positioned between adjacent barrier wall modules disposed in end-to-end relation to one another atop said retaining wall;

said flat base including an end part and a flat arm, said flat arm being integrally formed with and extending from said end part in co-planar alignment with said flat end part;

a retaining wall-receiving notch cut out from said end part, said notch having a depth sufficient to receive a predetermined vertical extent of said retaining wall therein and having a width sufficient to receive a predetermined width of said retaining wall;

said flat base further including an elongate bolt, said elongate bolt being secured to and extending from said flat arm in longitudinal alignment with said flat arm;

a nut in screw-threaded engagement with said elongate bolt;

a housing that ensleeves said flat arm and said elongate bolt and which is slideably mounted with respect to said flat arm and said elongate bolt;

said housing being movable toward said end part when said nut is advanced toward said end part;

said housing adapted to abut a first side of a pair of adjacent barrier modules when said nut is advanced;

whereby advancement of said first nut positions adjacent barrier modules in flush relation to one another atop said retaining wall.

6. The apparatus of claim 5, further comprising:

said housing having a parallelepiped structure that includes sidewalls disposed parallel to said flat arm and said elongate bolt, an inboard wall disposed transverse to said sidewalls and an outboard wall disposed transverse to said sidewalls.

7. The apparatus of claim 6, further comprising:

said inboard wall of said housing having a central aperture formed therein to slidingly receive said elongate bolt;

said inboard wall of said housing having a pair of rectangular slots in open communication with said central aperture and extending radially from said central aperture in opposite directions, said pair of rectangular slots slidingly receiving said flat arm;

said outboard wall of said housing having a central aperture formed therein to slidingly receive said elongate bolt.

8. The apparatus of claim 7, further comprising:

said inboard wall of said housing including a flange so that pressure applied to adjacent barrier modules by said housing is spread over a large surface area.

* * * * *